US007527008B2

(12) United States Patent
Mehta

(10) Patent No.: US 7,527,008 B2
(45) Date of Patent: May 5, 2009

(54) BALLAST MATERIAL AND OIL POLLUTION PREVENTION MANAGEMENT SYSTEM

(76) Inventor: Virendra J Mehta, Kamat Classic, 8-T/2 Phase 4, Caranzalem, Panjim Goa 403002 (IN)

( * ) Notice: Subject to any disclaimer, the term of this patent is extended or adjusted under 35 U.S.C. 154(b) by 279 days.

(21) Appl. No.: 10/572,211

(22) PCT Filed: Sep. 23, 2003

(86) PCT No.: PCT/IN03/00321

§ 371 (c)(1),
(2), (4) Date: Mar. 17, 2006

(87) PCT Pub. No.: WO2005/028296

PCT Pub. Date: Mar. 31, 2005

(65) Prior Publication Data

US 2008/0072809 A1 Mar. 27, 2008

(51) Int. Cl.
*B63B 25/08* (2006.01)

(52) U.S. Cl. ..... 114/74 T; 114/121; 114/125

(58) Field of Classification Search ..... 114/74 T, 114/121, 125

See application file for complete search history.

(56) References Cited

U.S. PATENT DOCUMENTS

| | | | | |
|---|---|---|---|---|
| 3,083,669 | A * | 4/1963 | Bunn et al. | 114/74 A |
| 3,473,502 | A * | 10/1969 | Wittkamp | 114/61.23 |
| 3,839,977 | A * | 10/1974 | Bradberry | 114/256 |
| 5,353,728 | A * | 10/1994 | Strange | 114/74 R |
| 6,053,121 | A | 4/2000 | Tamashima et al. | |
| 6,178,991 | B1 | 1/2001 | Schiwek | |
| 6,447,720 | B1 | 9/2002 | Horton, III et al. | |
| 6,500,345 | B2 | 12/2002 | Constantine et al. | |
| 6,516,738 | B2 | 2/2003 | Cannon | |

* cited by examiner

*Primary Examiner*—Stephen Avila
(74) *Attorney, Agent, or Firm*—Lau & Associates, LLC.

(57) ABSTRACT

The invention provides for a novel apparatus and a method to effectively manage ballast material. It comprises of a plurality of Floating Ballast Containers (25) contained within a bottomless enclosure and secured on the sea faring vessel such that each floating ballast container (25) floats in seawater. The volumetric capacity of the conventional segregated ballast tanks (30) on the sea faring vessel is similar to that of the Floating Ballast Containers (25) so as to facilitate the movement of the ballast material between the conventional ballast tanks (30) and Floating Ballast Containers (25). This process eliminates the need for treatment or disposal of the ballast material in to the sea.

16 Claims, 7 Drawing Sheets

BALLAST MATERIAL AND OIL POLLUTION PREVENTION MANAGEMENT SYSTEM

FIELD OF INVENTION

This invention relates to an apparatus and method for internal exchange of ballast water between the rubberized floating ballast tanks and segregated ballast tanks and thereby avoiding the disposal or treatment of ballast water completely.

BACKGROUND OF INVENTION

A cargo sea faring vessel routinely docks at ports to load cargo and transports it to another port where the cargo can be unloaded. Once the cargo has been unloaded, the vessel is lighter and therefore, in order to compensate for the weight lost, ballast material is filled into specially constructed ballast tanks. This helps the sea faring vessel maintain balance and stability when it travels empty. Seawater is found to be a very convenient ballast material since it is easily available. By installing pumps on the sea faring vessels, seawater could be filled in to the conventional segregated ballast tanks. On reaching the first port, the ballast water was disposed off into the ocean without adequate treatment. This water contained planktons and other marine organisms specific to the port where the ballast material had been loaded. Disposing the ballast water at a different port caused these living organisms to be transferred into another ecological habitat thereby creating several biological hazards and extinction of various living organisms. Thus transfer of ballast water from a port of one country to port of other country poses a big environmental problem and is detrimental to the ecosystem of the place where the new ballast water is disposed off.

The advent of laws governing the disposal of ballast water and the need for adequate treatment of the ballast water has led to extensive research and development worldwide. In 1996, The United States Congress passed the National Invasive Species Act (P. L. 104-332) to stem the spread of non-indigenous organisms by ballast water discharge. The Act reauthorized the Great Lakes ballast management program and expanded applicability to vessels with ballast tanks. The Act requires the Secretary of Transportation to develop national guidelines to prevent the spread of organisms and their introduction into U.S. waters via ballast water of commercial vehicles.

The Act establishes guidelines that require vessels that enter the U.S. waters after operating to undertake ballast exchange in the high seas. In this method, a vessel empties its ballast on the high seas and refills the ballast tanks with the high seawater. However, the emptying of ballast tanks causes an imbalance that makes the exchange of ballast material on the high seas both dangerous and sometimes impossible because of weather conditions.

Therefore, the need for an effective and economical ballast material management apparatus, method or process was felt.

Numerous methods and compositions have been proposed to control and inhibit the growth of various marine plants and animals. In particular, a number of compositions have been proposed to treat water and various surfaces having infestation of zebra mussels and other marine organisms. The various patents cited below represent the prior art for ways to treat the ballast water.

U.S. Pat. No. 6,500,345

This patent discloses an apparatus and method for treating water to be supplied to a ballast tank using a water pathway having a main inlet for connection to a body of navigable open raw water containing sediment and marine organisms, and a main outlet for connection to the vessel's ballast tank. It uses a centrifugal separator to separate sediment and some water from the raw water.

U.S. Pat. No. 6,516,738

This patent discloses the use of ozone through an ozone transport system to treat the ballast material.

U.S. Pat. No. 6,447,720

This patent discloses an ultraviolet disinfection system and method for treating fluids including a configuration and design to function effectively with at least one UV light source or lamp that is not submerged in the fluid.

U.S. Pat. No. 6,053,121

This patent discloses a method and apparatus for exchanging ballast material in a ballast tank of a sea faring vessel as well as a sea faring vessel provided with a system for exchanging ballast material using differences in pressure to drive ballast material in and out of the ballast tanks.

U.S. Pat. No. 5,353,728

An improved tanker ship construction design includes a plurality of liquid cargo tanks distributed in two longitudinal sets along each side of a tanker ship. A plurality of fully protected ballast tanks are distributed longitudinally between the sets of cargo tanks. A passive, gravity-responsive, fluid transfer system provides very rapid fluid communication between selected cargo tanks and adjoining ballast tanks. A gravity responsive fluid transfer system is provided between the respective ballast tanks.

Extensive research and development works is in progress worldwide; the technologies being researched include filtration and physical separation, treatment with chemicals, ultraviolet light, ozone, heat, de-oxygenation, electro-ionization, gas super-saturation and various combinations. These methods are not economical and also pose various other drawbacks. For example, treatment with chemicals such as chlorine introduces harmful chemicals into the water, chemicals used are quite expensive, some methods are not able to handle large amount of water at a high pumping rate. According to the International Maritime Organization (IMO), shipping transfers more than 10 billion tons of ballast material around the globe each year. Thus, using chemicals, ozone, UV rays etc are not economically viable options.

Another common problem faced, which disrupts and damages the marine ecosystem is the spillage of oil caused by oil tankers. In recent times, there have been numerous tanker disasters resulting in major oil spills and there exists need to provide adequate measures to curb and control the spillage. A possible solution could be to provide a shielding that can absorb shocks during collisions that tear apart the oil tanks. The United States made it mandatory that all new tankers operating in U.S. waters to be built with double hull construction and the existing single hull tankers to be modified to suit the required double-hull arrangement or be phased out and scrapped when they reach a predetermined age.

U.S. Pat. No. 6,178,991

This invention comprises of a safety container for storing and transporting environmentally hazardous, in particular explosive substances, such as gasoline, oil, hydrogen, and other fuels, consisting of an extended container closed on all sides, which is provided with filling and emptying devices or openings, and which is integrated into a transport vehicle or associated with such.

The patents listed above identify some measures that have been taken to prevent oil spills. There have been various measures taken to separate the oil spilt from the water as well. This signifies that the damages caused by ballast material being released at various ports and oil spills due to collisions at sea pose a substantial biohazard and there exists a need to rectify the problem as soon as possible.

SUMMARY OF INVENTION

The following displays the preferred embodiment of the invention. The apparatus comprises of large rubberized containers, designed to fit within the main body of the exterior hull port and starboard. The exterior hull is hollow from the bottom, thus allowing the rubberized ballast tanks to float in the seawater by virtue of its own buoyancy. (The material/body/object that floats due the buoyant force exerted by the liquid is called a buoyant material/body/object.) Therefore, the weight of the tanks is not borne by the sea faring vessel itself. These floating containers are called the floating ballast containers ('FBC'). The conventional layout on a tanker is such that the cargo tanks are positioned at the center whereas the conventional ballast tanks are located on the wings in the fore and aft direction. These conventional ballast tanks are divided into a number of compartments and are mainly referred to as segregated ballast tanks ('SBT'). Each FBC is positioned adjacent to these SBT's. The dimensions of an FBC are similar to the adjacent SBT. The FBC's are enclosed tightly within the exterior hull with due tolerance for expansion and contractions; so that it forms a kind of rigid compact unit when the vessel is in motion, without causing any vibration or motion of its own. The cargo section, the FBC's and the SBT's are held tightly with girders to disperse the shock experienced incase of a collision. The individual FBC's are held with the help of four bridal chains connected to a single main chain. This main chain goes over a gypsy of windlass (a kind of a pulley system), which helps in lowering or hoisting the FBC's. Shock absorbing springs are sandwiched between the upper main deck area and the FBC's so as to absorb the hydrostatic forces due to the up and down movement of the FBC's. Pipes are provided to facilitate transfer of ballast material to and from the FBC's with the help of a pumping system.

A typical SBT is required to have ballast reserves of 33% of the sea faring vessels weight. By incorporating FBC's, the ballast reserves can extend to 40%, which enables smooth vessel operation and achieves effective working control.

In an exemplary working of the system the sea faring vessel transfers the ballast material from the SBT's to the FBC's when the sea faring vessel is loaded with cargo. After unloading the cargo, the ballast material is shifted back to the SBT's and using this mode of exchange for the ballast material, the need for ballast material to be discharged or treated is eliminated. This would provide for good clean tanks with good protective coatings and facilitate tank inspections. The need for discharging & reloading ballast material is eliminated thereby saving considerable amount of time and energy. The invention provides for greater flexibility and effective working control during cargo operation, as the ballast material has to undergo an internal ballast transfer instead of different kinds of water treatment and disposal of ballast at sea.

Another problem addressed by the invention is the spillage of oil at sea due to collisions. The size of the exterior hull extends from the deck of the sea faring vessel to the keel. The size and design of the FBC's is such that it can be designed or made to extend deeper in to the waters than the keel of the sea faring vessel. This ensures that in case of grounding/underwater obstructions, the FBC's absorb the impact energy thus protecting the main cargo tank area. The exterior hull also helps in absorbing the shock in the event of any such collisions.

DETAILED DESCRIPTION OF DIAGRAMS

Several examples of the present inventions are described in more detail with reference to the drawings. The present invention is not necessarily limited to these examples.

Figure 1:
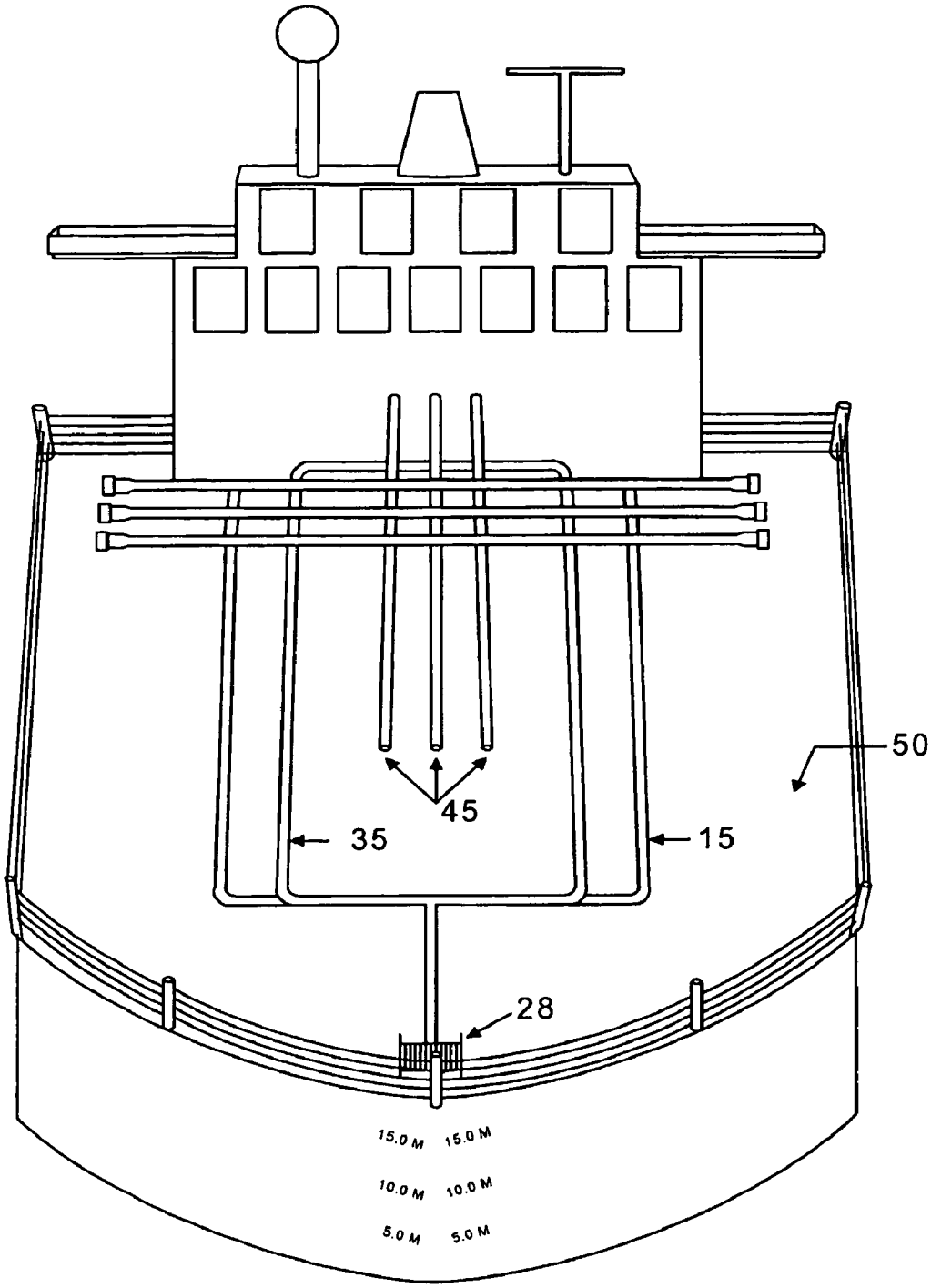
FIG. 1 displays the front view of the vessel with the invention incorporated

FIG. 1 displays the front view of the sea faring vessel with the various pipes 15 45 35 to transfer the ballast material between the SBT and FBC and loading and unloading of the oil from the cargo tank. The main deck area 50 gets additional surface area throughout the length of the vessel due to the deck extending up to the exterior hull.

Figure 2A:
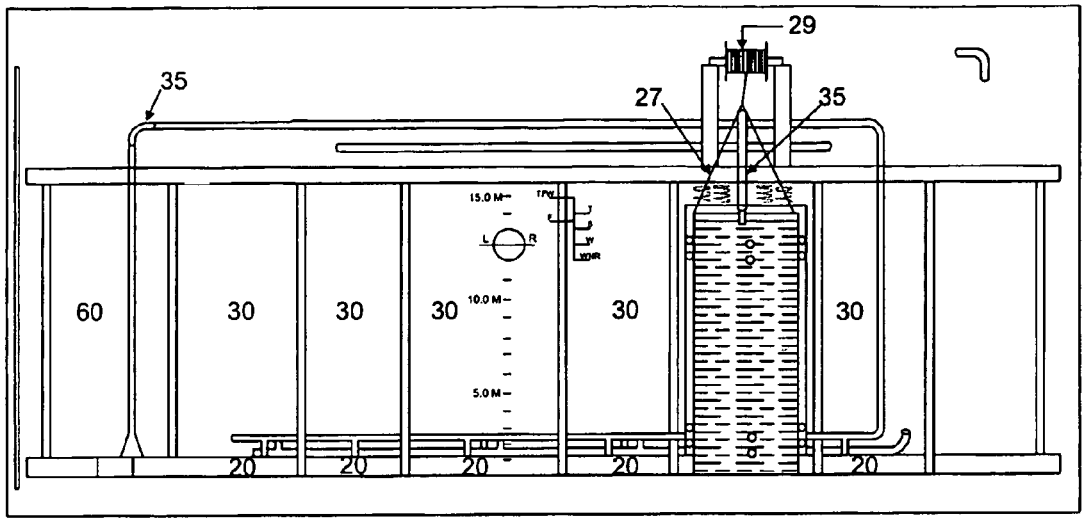
FIG. 2A shows the cross sectional side view of Floating Ballast Containers
Figure 2B:
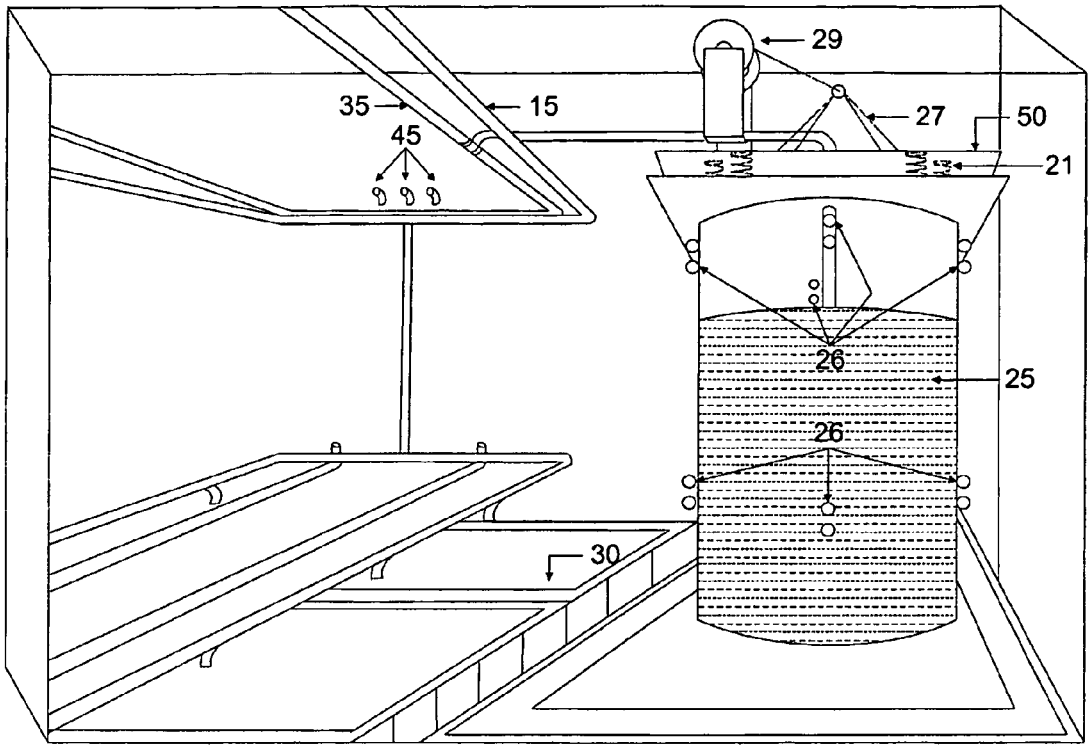
FIG. 2B shows the cross sectional front view of Floating Ballast Containers

FIGS. 2 (A & B) show the cross sectional views of the FBC 25 displaying the specifics of their construction. It displays the preferred embodiment of the invention, wherein rubberized FBC's 25 are designed to fit within the main body of the exterior hull port and starboard leaving the bottom open. This eliminates the additional weight of the tanks being borne by the sea faring vessel. The FBC's 25 are constructed with similar dimensions as the SBT's 30 and are positioned adjacent to the SBT's 30 to facilitate transfer of ballast material.

The FBC's 25 are positioned within the inner section of the exterior hull such that the inner wall clearance is kept to minimum around the periphery with due tolerance for expansion and contraction. This forms a rigid compact unit without causing any motion or vibration of its own. The figure displays the FBC's 25 mounted on a roller track 26 on all sides of the inner section hull to facilitate the movement of the tank in up and down directions.

Each unit of the FBC 25 is suspended by four bridal chains 27 that are then connected to a main chain 46 passed on the "Gypsy of the Windlass" 29 located right above the FBC's 25 on the main deck 50. This arrangement helps in lowering and hoisting the FBC's 25 as per the need, especially while arriving at a port or maneuvering the sea faring vessel in shallow waters. In the preferred embodiment, wire guide leads with associated fittings are provided for each tank such that the windlass on the foxle (front) deck could effectively be used to enable the process of hoisting and lowering the FBC's. In an alternate embodiment, this arrangement can be provided to each FBC.

The upper sections of the ballast tanks are fitted with a sandwich plate with a series of buffer springs 21 to absorb the hydrostatic shocks and protect the upper main deck area 50. The main deck 50 area gets additional surface area throughout the length of the vessel due to the deck being extended up till the exterior hull enclosing the FBC's. This additional free surface area 50 on the main deck port and starboard side of the vessel provides adequate space to mount windlass systems on each of the tanks. For vessels other than tankers, this additional space could be utilized for deck cargo storage.

Figure 3:
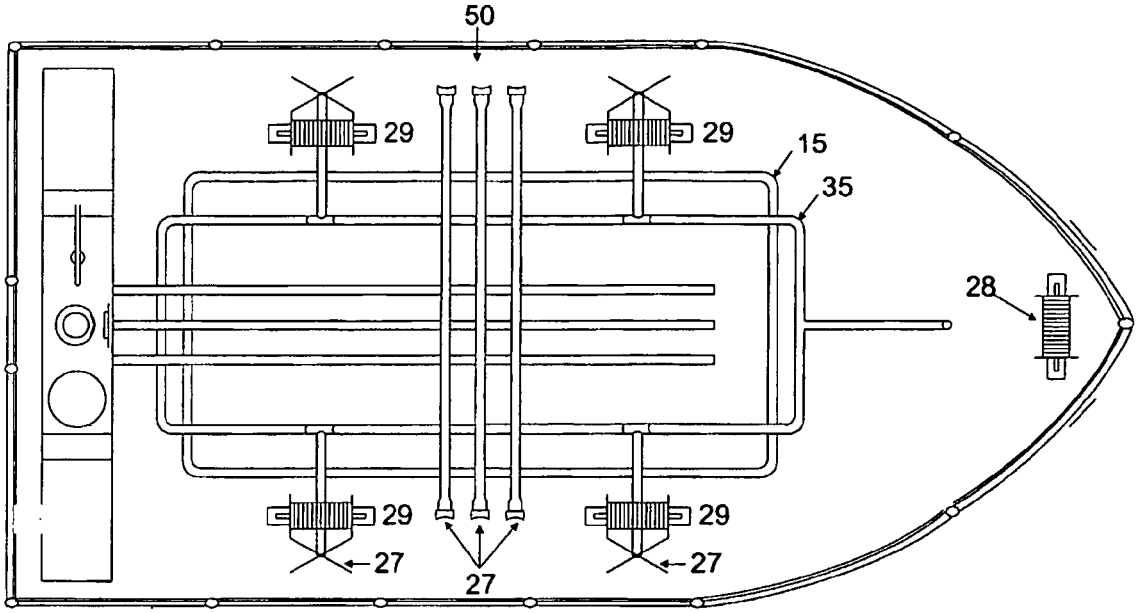
FIG. 3 shows housing and winch arrangements of Floating Ballast Containers.

FIG. 3 shows the preferred arrangement in which each FBC is held together with a system comprising of four chains 27, connected to a main chain 46. This main chain 46 is passed over a gypsy of the windlass 29 (a kind of a pulley system). In the preferred embodiment all the FBC's are held together with chains and passed over a single central gypsy of the windlass 28 fixed on the foxle (front) deck. An alternate embodiment wherein each FBC 25 can be equipped with its own gypsy can also be used.

Figure 4:
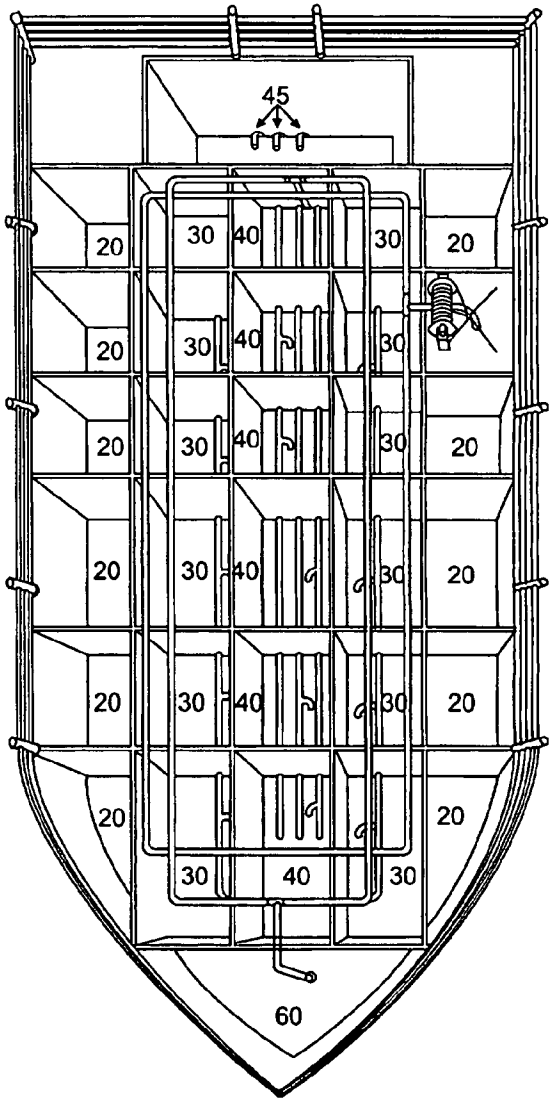
FIG. 4 displays the layout of the conventional segregated ballast tanks, floating ballast containers as well as cargo tanks

FIG. 4 shows the layout of the preferred embodiment wherein the SBT's 30, the main cargo tanks 40 and the FBC's 25 are placed in the compartments 20 formed between the exterior hull and the hull before the exterior hull adjacent to the SBT's. The cargo tanks 40 are positioned at the center where as the SBT's 30 are located on the 'wings' in the fore and aft directions. The SBT's 30 are totally independent and have their own independent pumping and piping system. The SBT's 30 are designated to take in and discharge ballast material for stability requirements. The size of the FBC's 25 is similar or bigger than the SBT's 30. The FBC's 25 are enclosed tightly within the exterior hull with due tolerance for expansion and contractions.

Figure 5A:
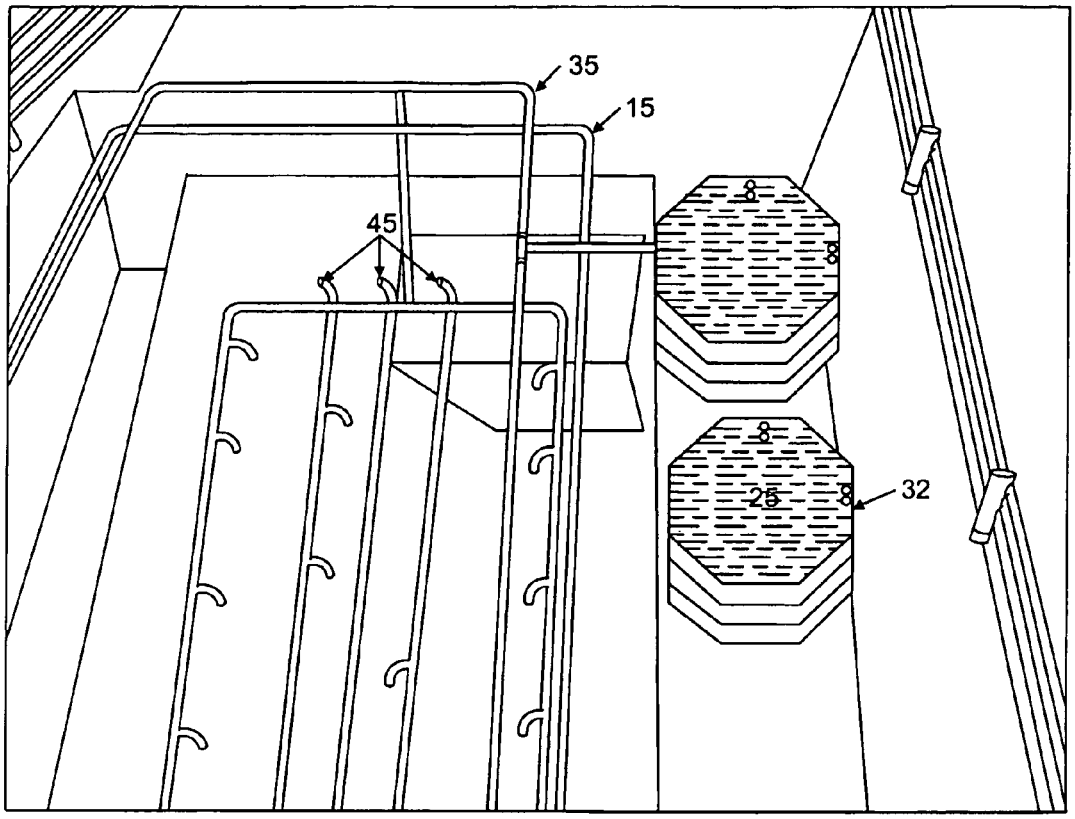
FIG. 5A shows the top view of the girders enclosing the Floating Ballast Tanks.
Figure 5B:
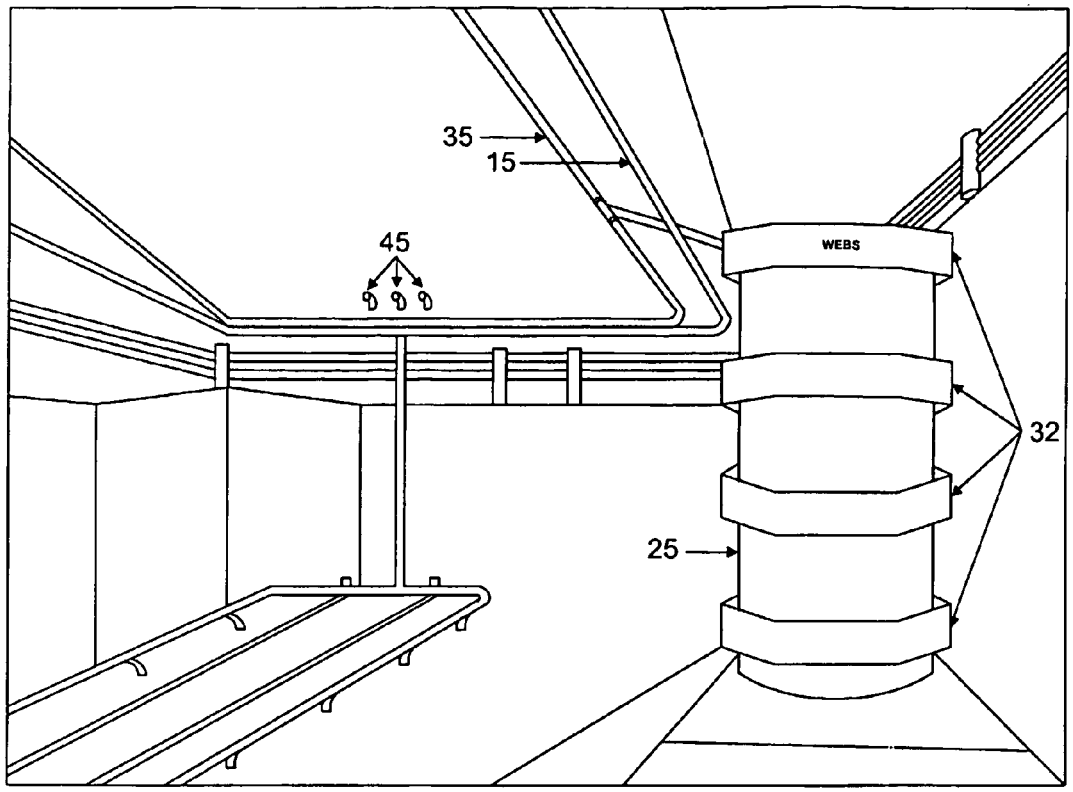
FIG. 5B shows the front view-of the girders enclosing the Floating Ballast Tanks.

FIGS. 5 (A & B) displays the arrangement of the girders 32 that run around the FBC's 25. The girders 32 are constructed to protect the ship during an impact by dispersing the shock over a wider surface area. The various pipes 15 35 45 to transfer the ballast material between the SBT and FBC and loading and unloading of the oil from the cargo tanks are also depicted.

The invention claimed is:

1. A system to manage ballast material on a sea faring vessel, the system comprising:

a bottomless enclosure containing a plurality of floating ballast containers on the sea faring vessel with a bottom, the floating ballast containers made of a buoyant material that enables the floating ballast containers to float on water when filled with a ballast material;

a plurality of conventional ballast tanks; and means to transfer the ballast material back and forth from the plurality of conventional ballast tanks to the plurality of floating ballast containers;

wherein the plurality of floating ballast containers is moveable relative to the bottomless enclosure.

2. The system of claim 1, wherein the plurality of floating ballast containers are designed to float in water by virtue of its own buoyancy, the floating ballast containers being filed with or without ballast material.

3. The system of claim 1, wherein the floating ballast containers contain a shock absorbing system to absorb any shock experienced during movement.

4. The system of claim 3, wherein the shock absorbing system includes an option of having girders surrounding the plurality of floating ballast containers.

5. The system of claim 1, wherein the ballast material includes water.

6. The system of claim 1, wherein the buoyant material includes rubber.

7. The system of claim 1, wherein an exterior hull serves as the bottomless enclosure.

8. The system of claim 1, wherein the floating ballast containers is submerged below the level of the keel of the sea faring vessel to protect the sea faring vessel against any underwater collision.

9. A method for managing the ballast material on a sea faring vessel, the method comprising:

suspending a plurality of floating ballast containers in seawater, the floating ballast containers contained a bottomless enclosure on the sea faring vessel with a bottom;

loading the plurality of floating ballast containers with a ballast material when the sea faring vessel is loaded with cargo; and transferring the ballast material from the plurality of floating ballast containers to conventional segregated ballast containers when the cargo has been unloaded from the seafaring vessel;

wherein the plurality of floating ballast containers is moveable relative to the bottomless enclosure.

10. The method of claim 9, wherein the plurality of floating ballast containers are designed to float in water by virtue of its own buoyancy, the floating ballast containers being filed with or without ballast material.

11. The method of claim 10, wherein the floating ballast containers contain a shock absorbing system to absorb any shock experienced during movement.

12. The method of claim 11, wherein the shock absorbing system includes an option of having girders surrounding the plurality of floating ballast containers.

13. The method of claim 10, wherein the ballast material includes water.

14. The method of claim 10, wherein the buoyant material includes rubber.

15. The method of claim 10, wherein an exterior hull serves as the bottomless enclosure.

16. The method of claim 10, wherein the floating ballast containers are submerged below the level of the keel of the sea faring vessel to protect the sea faring vessel against any underwater collision.

* * * * *